United States Patent [19]

Morini

[11] Patent Number: 4,465,641

[45] Date of Patent: Aug. 14, 1984

[54] CARBURETOR FOR SPARK-IGNITION INTERNAL COMBUSTION ENGINES

[76] Inventor: Marco Morini, 108 via, Ponte Romano, 1-10027 Saint-Vincent, Aosta, Italy

[21] Appl. No.: 390,864

[22] Filed: Jun. 22, 1982

[30] Foreign Application Priority Data

Jul. 2, 1981 [IT] Italy ..... 67919 A/81

[51] Int. Cl.[3] ..... F02M 11/08

[52] U.S. Cl. ..... 261/41 C

[58] Field of Search ..... 261/41 C, 41 A, 41 B

[56] References Cited

U.S. PATENT DOCUMENTS

| | | | |
|---|---|---|---|
| 900,604 | 10/1908 | Small | 261/41 C |
| 948,612 | 2/1910 | Krause | 261/41 C |
| 1,180,976 | 4/1916 | Cloudsley | 261/41 C |
| 1,205,602 | 11/1916 | Disturnal | 261/41 C |
| 1,485,759 | 3/1924 | Ball | 261/41 C |
| 1,586,097 | 5/1926 | McCarthy et al. | 261/41 C |
| 1,986,321 | 1/1935 | Chanard | 261/41 C |
| 2,049,180 | 7/1936 | Surra | 261/41 C |
| 2,086,292 | 7/1937 | Chanard | 261/41 C |
| 2,454,974 | 11/1948 | Mennesson | 261/36 A |
| 2,638,330 | 5/1953 | Morgenroth | 261/41 C |
| 2,783,981 | 3/1957 | Briggs | 261/41 C |
| 2,977,099 | 3/1961 | Ball | 261/36 A |
| 3,999,522 | 12/1976 | Jaulmes | 261/41 C |
| 4,139,580 | 2/1979 | Tuckey et al. | 261/35 |

*Primary Examiner*—Tim R. Miles

*Attorney, Agent, or Firm*—Young & Thompson

[57] ABSTRACT

A carburetor for spark-ignition internal combustion engines, comprising a plurality of chokes formed in a body and cooperating with a shutter which is displaceable perpendicularly to the axis of the chokes and has passage openings so shaped and arranged as to uncover the chokes in sequence, so that, in the various operating conditions, all the active chokes operate at their full opening excepting only the last which may be partially shut. The result is a greater efficiency, a better combustion and a reduction of the exhaust gas pollution. In the preferred embodiment, the chokes are arranged along circle arcs, and the shutter is a rotating disc having arcuate openings, located between the body wherein the chokes are formed and an underlying distributor. The various chokes may be differently sized and provided with different nozzles in order to obtain the best metering in the various operating conditions. Also the shutter openings may be so profiled as to obtain a desired variation law of the carburetor openings.

9 Claims, 7 Drawing Figures

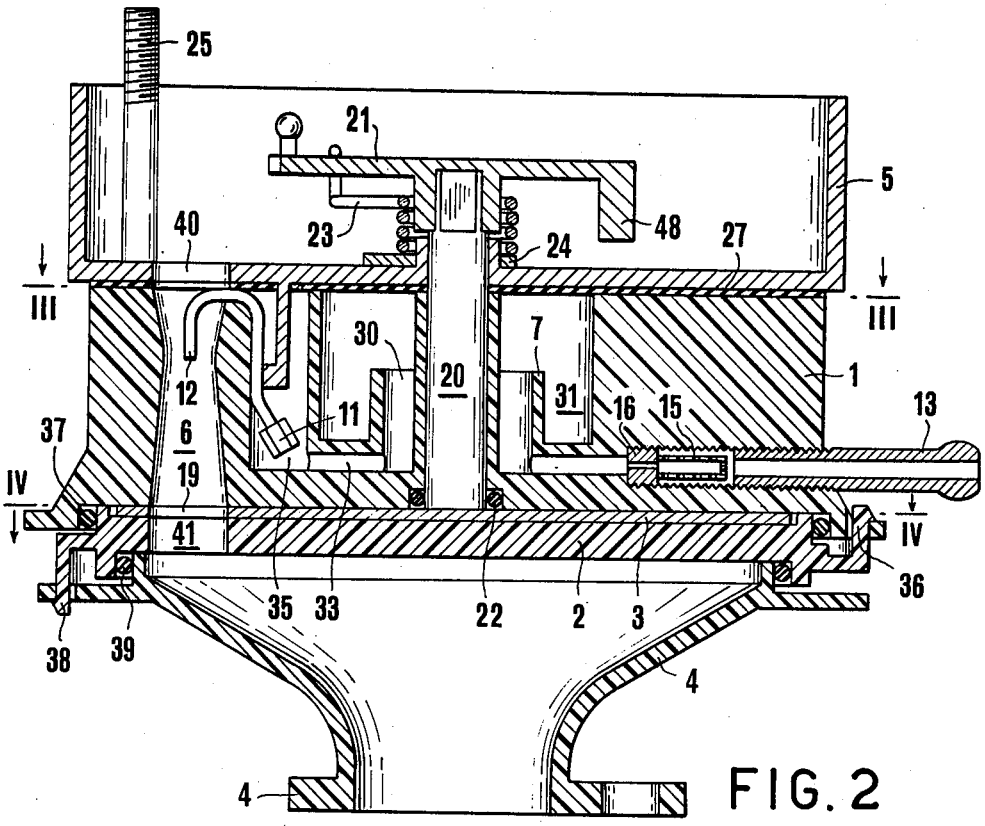
FIG. 2
FIG. 5
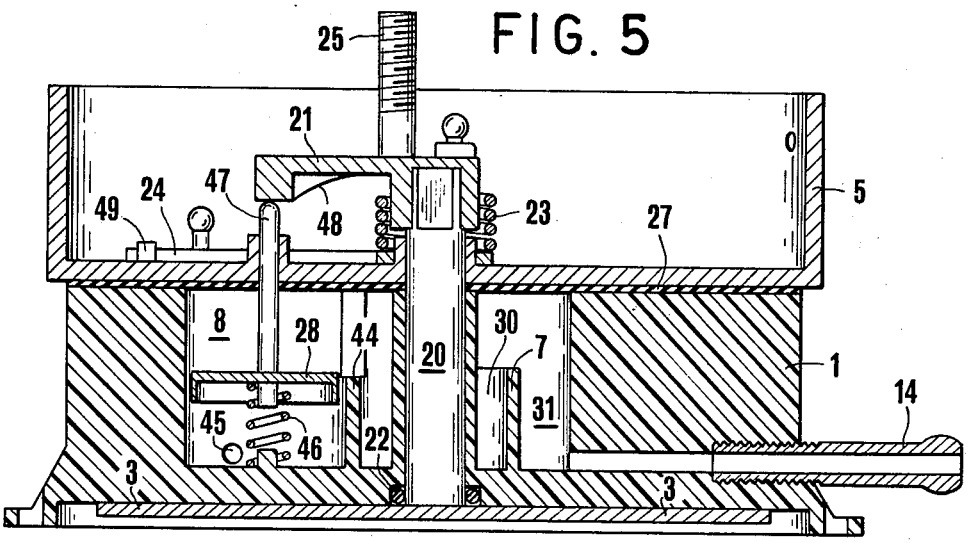

CARBURETOR FOR SPARK-IGNITION INTERNAL COMBUSTION ENGINES

BACKGROUND OF THE INVENTION

This invention relates to a carburetor for Otto cycle motors, of the type wherein the fuel is kept at a constant level within a fuel chamber and is introduced in the air flow, sucked by the motor, by the effect of depression produced by the flow in the nozzle throat area of a venturi tube choke.

In the known carburetors with a single body, the control of the motor speed is effected by means of a throttle valve which reduces in a variable ratio the intake pipe downstream from the choke. In the greatest part of the operating conditions, the resulting flow is therefore throttled and its speed through the choke is not the optimum one which produces the best admixture conditions. For said reasons, and due to the fact that the jet nozzle is unchangeable, it is not possible to obtain for all the operating conditions the most rational fuel feeding, and compromises must be accepted whose results are efficiency losses, worsening of the combustion and a greater atmospheric pollution.

An improvement of said conditions is obtained by the twin carburetors, wherein a first carburetor body controls the motor operation within the range of lower speed, in which a second body remains inactive, while from a preestablished condition onwards the first body continues its operation without any throttle, and the control is entrusted to the second body, which acts in parallel with the first one. Also in this case, however, there is a great number of operating conditions wherein an important fraction of the fuel is introduced in a highly throttled choke and causes efficiency losses, a bad combustion and pollution.

BRIEF SUMMARY OF THE INVENTION

The object of the present invention is to provide a carburetor allowing to maintain, in substantially all the operating conditions, a correctly controlled feeding, so as to assure the greatest efficiency, a very good combustion and the reduction to the minimum of the atmospheric pollution by exhaust gases.

Said object may be achieved, according to this invention, by means of a carburetor of the type set forth in the preamble, comprising more than two chokes co-operating with a shutter, the active surface of the shutter extending in a direction substantially perpendicular to the axis of said chokes, and the shutter having passage openings so shaped as to uncover in sequence said chokes according to a pre-established rule.

In this way, in any operating condition, only the last uncovered choke or (during the strictly limited phases of passage of the control from a choke to the subsequent) at the maximum two chokes are less or more throttled, while all the chokes which have been previously uncovered operate in the best conditions, thus assuring in their whole a clear improvement of the carburetion. Furthermore, the chokes which have to be uncovered in the various operating conditions may be of different sizes and/or provided with nozzles of different size, thus allowing to conform the feeding conditions, in the best possible way, to the different operating conditions, so that a further improvement is introduced in the carburetion and in the motor operation.

The various chokes of the carburetor are preferably arranged with their axes parallel to one another, and the shutter is flat and displaces in a plane perpendicular to the choke axes. Further, the chokes are preferably arranged along circle arcs around a center, and the shutter is rotatable around said center. Said arrangements allow to make particularly compact the carburetor. The manufacture of the carburetor is simple and cheap and allows the use of materials and technologies which are not admitted by the usual construction of the carburetors, thus obtaining easily , by mass production and at a low cost, devices of high precision. Various components of the carburetor may be made, for example, of molded plastic materials.

When the chokes are arranged along circle arcs, the central zone of the carburetor may be advantageously occupied by a fuel bowl for the feeding of jets at a constant level, thus making the construction particularly compact. In this respect, a substantial simplification of the structure may be obtained by using an overflow fuel bowl, wherein the necessary fuel head is maintained by means of an overflow through which the fuel excess, fed by the feeding pump, is sent back to the tank by means of a recovery pump.

The chokes are advantageously arranged on two circle arcs opposite to one another with respect to the center, and the rotating shutter has two arcuate openings so located as to uncover alternatively a choke located on one arc and a choke located on the opposite arc. The arc sections which are not occupied by chokes may receive additional devices if required, such as a jet for the operation at minimum speed, an accelerator pump, and so on.

BRIEF DESCRIPTION OF THE DRAWINGS

The above and other particular features and advantages of this invention will more clearly appear from the following description of a preferred embodiment, having however the character of a non limiting example, which is diagrammatically represented on the annexed drawings, wherein:

FIG. 2 shows a vertical cross section taken along the broken line II—II of FIG. 1;

FIG. 5 is a vertical partial cross section taken along line V—V of FIG. 1.

DETAILED DESCRIPTION OF A PREFERRED EMBODIMENT

Figure 1:
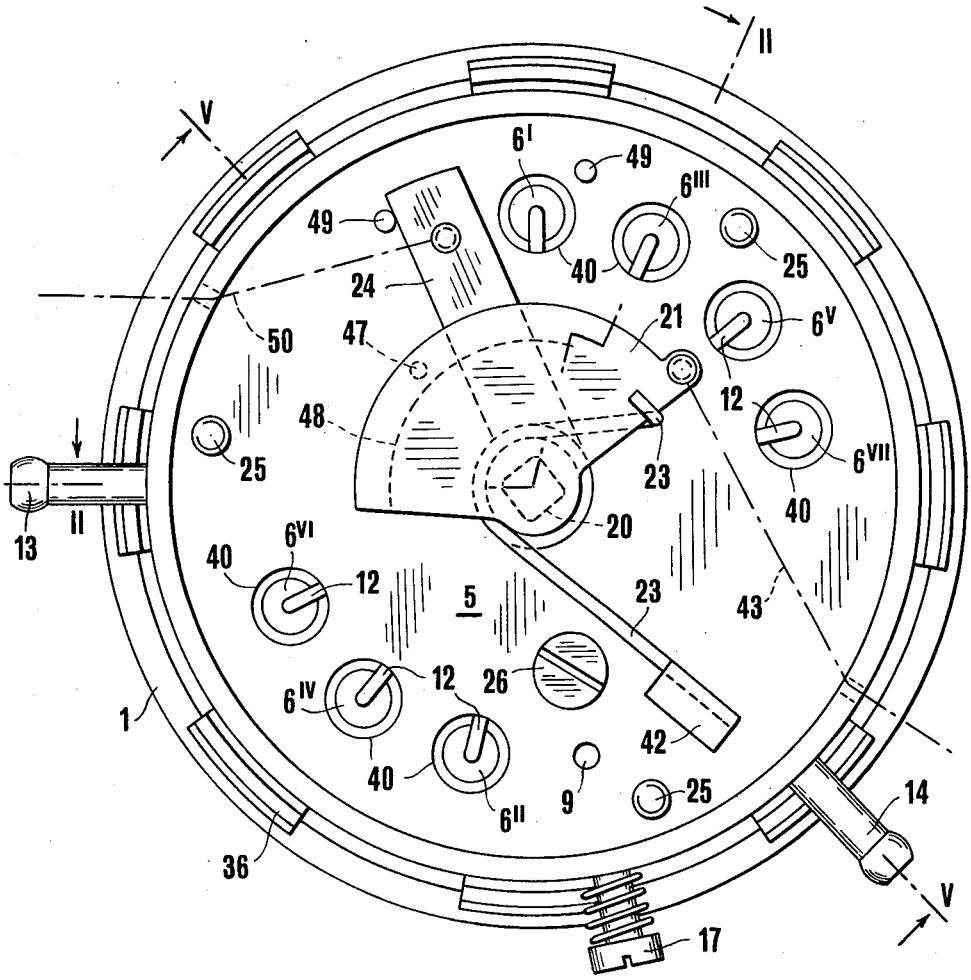
FIG. 1 is a plan view of the carburetor according to the invention, without the air filter usually superimposed on it.
Figure 3:
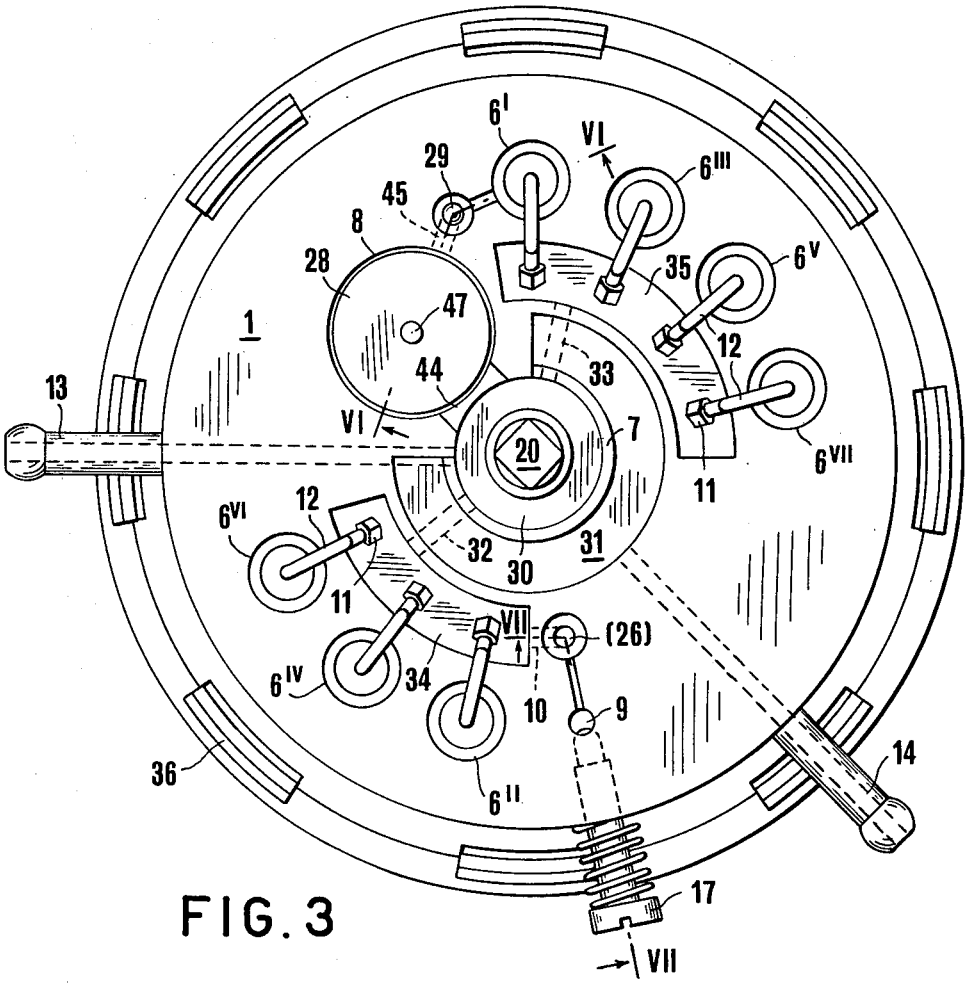
FIG. 3 shows in a plan view the carburetor, with all the parts laying above line III—III of FIG. 2 removed.

The represented example refers to a backflow type carburetor, with seven chokes arranged along circle arcs and co-operating with a rotating shutter, with an overflow fuel bowl, a device for the operation at the minimum speed and an accelerator pump, but, as already stated, these choices refer to a particular embodiment and must not be considered as restrictive of the scope of the invention.

The structure of the represented carburetor comprises mainly a body 1, an underlying distributor 2, a manifold 4 and a cover 5. The latter is applied to the body 1 by means of screws, not represented, and with interposition of a flat sealing gasket 27; the distributor 2 is fixed to the body 1 by means of elastic snap teeth 36 and with interposition of a sealing toroidal gasket 37; the manifold 4 is fixed to the distributor 2 by means of elastic snap teeth 38 and with interposition of a toroidal sealing gasket 39. As it will be understood, these connection systems presuppose the manufacture of the distributor 2 from a plastic material, as it is made possible by the invention principles. The manifold 4 is intended to be mounted on the intake manifold (not represented) of a carburation motor, and an air intake filter is intended to be mounted on the cover 5; for the fastening of the filter box, the cover 5 has threaded shanks 25; the air filter is not represented.

The body 1 is traversed by a number of chokes 6, in this case seven, spaced along a circumference and forming two groups comprising respectively four and three chokes. To the chokes 6 of body 1 correspond, in the cover 5 and in the distributor 2, the holes 40 and 41 respectively, which extend the outline of the chokes 6. Within each choke 6, and strictly near its restricted cross section, opens an end of a pipe 12 which is suitably bent and has a nozzle 11 applied to its opposite end. The various nozzles 11 of the two choke groups are immersed in fuel chambers 35 and 34 respectively, which, through ducts 33 and 32, communicate with a central constant level fuel bowl 30. This fuel bowl is fed by a usual feeding pump (not represented) through a connector 13, a fuel filter 15 and a flow metering nozzle 16. The constant level is maintained by an overflow 7, beyond which the excess of fed fuel flows within an arcuate fuel chamber 31 and from there to a connector 14 intended to be connected to a recovery pump (not represented) which returns to the tank the surplus fuel. Due to the communications 32 and 33, the same constant level of the fuel bowl 30 is maintained within the fuel chambers 34 and 35 and submerges, under a pre-established head, the nozzles 11 of pipes 12.

Figure 4:
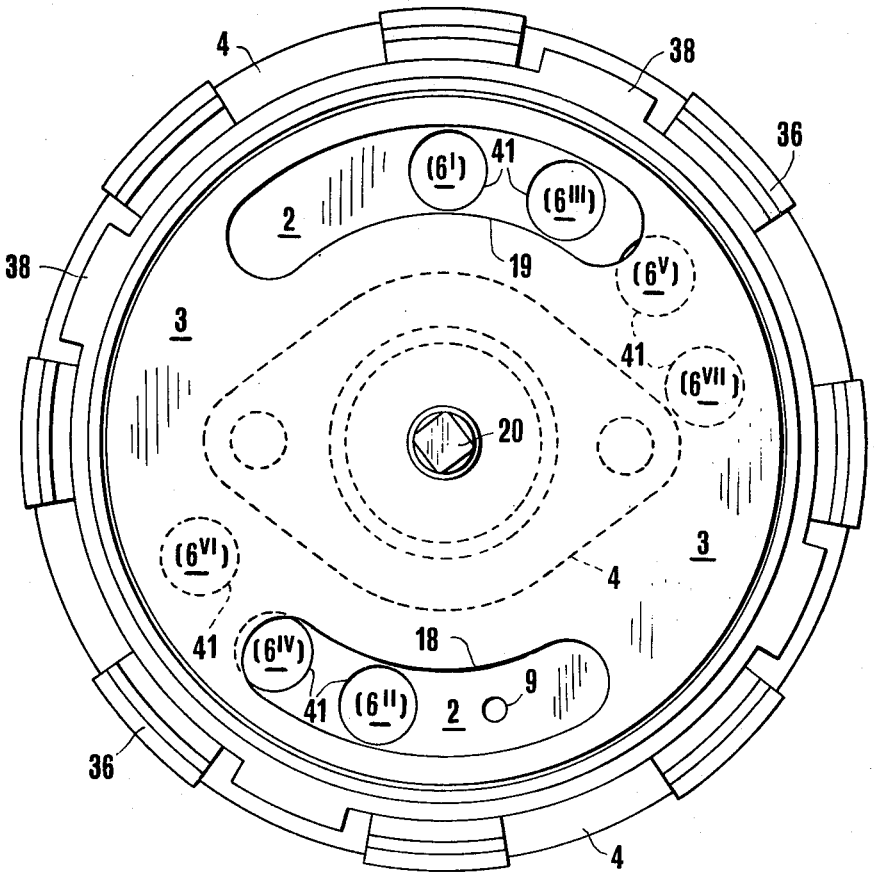
FIG. 4 shows in a plan view the carburetor, after removal of the parts lying above the line IV—IV of FIG. 2.

Between the body 1 and the distributor 2 is arranged a rotating shutter formed by a plate 3 provided with two arcuated slits 18 and 19. Said slits are so arranged that, in a position of the plate 3 (complete opening), they leave free all the chokes 6 of the two groups, in another position (complete closure) they occlude all the chokes, and when passing from said last position to the first, they gradually uncover at once only the first choke 6′ (of the first group) and then, after the complete opening of the first choke 6′, they uncover the second choke 6″ (of the second group), the third choke 6‴ (again of the first group) and so on. In practice, as may be observed from FIG. 4, it is preferable to provide some overlapping of said openings, that is, to begin the opening of each choke slightly before the completion of the opening of the preceding one, in order to obtain a greater graduality in the increase of the total opening. Further, the complete closure position may be not really obtainable, since usually a certain opening of the shutter, even during the operation at a minimum speed, is required. For an easier understanding of this gradual opening process, the reference numbers from 6′ to 6$^{v''}$, relating to the chokes, are also shown in FIG. 4 in register with the respective holes 41 of the distributor.

Therefore, as will be understood, in any operating condition there is always a number of chokes 6 completely free, and substantially only one choke partially shut, so that the greatest part of the fuel is introduced in the sucked air flow through chokes operating in the best conditions. Due to the relatively high number of chokes, the carburetor operates at a nearly constant depression and, even in the operation with low charges, the air speed within the chokes (which can have a relatively small cross section) remains high, thus assuring a correct and uniform admixture.

It is further clear that, although the chokes 6 have been illustrated as identical to one another, they may have different cross section and/or they may be served by nozzles 11 of different size, so as to achieve, for each operating speed, the most suitable metering. Furthermore, although the slits 18 and 19 of the rotating shutter 3 have been illustrated as having an uniform width and terminating with circle arcs, they may be profiled in various manners, so as to define a suitable law for the variation of the total cross section of air passage as a function of the accelerator control, which law may be approximately linear, exponential or other, in order to obtain the best manoeuvrability of the motor.

The control of the rotating shutter 3 is effected by means of a shaft 20 which passes through the body 1 and cover 5 and, above the latter, is connected to a lever 21 which is pulled towards the minimum position by a spring 23 resting on a relief 42 of cover 5. To the lever 21, a bowden or other transmission of the acceleration control, not represented, will be connected so as to act substantially along the chain line 43 of FIG. 1. A toroidal gasket 22 establishes the sealing between shaft 20 and body 1.

Figure 7:
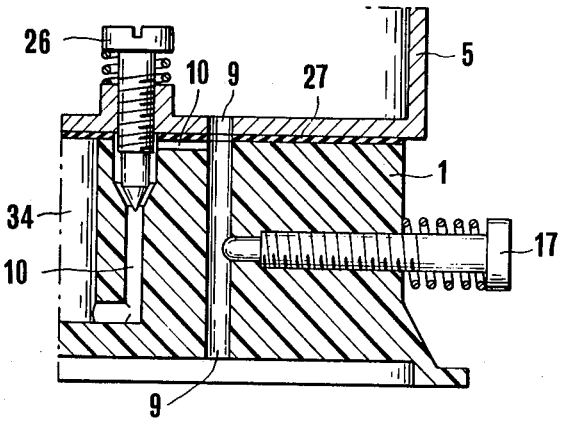

The operation at a minimum speed, in a carburetor according to the invention, may be made correct by providing a first choke particularly designed for said operation, and in such case no special device has to be provided for that object. Nevertheless, when it is desired to have a special device for operation at minimum speed, the device represented in FIGS. 1 and 7 may be used. In that case, from one of the fuel chambers feeding the fuel to the nozzles (the fuel chamber 34 in the example shown) a duct 10 carrying the fuel to a special air passage 9 is derived and passes through the body 1, the distributor 2 and the cover 5. The duct 10 may be more or less obturated by means of a pointed screw 26, and the air passage 9 may be more or less obturated by means of an adjustment screw 17. The operation at minimum speed may therefore be suitably adjusted by means of the screws 17 and 26. The passage 9 may be permanently open, as the effect of its cross section is negligible in the operation at greater speeds, or it may be suitably obstructed by the rotating shutter 3 from a determined feeding range onwards.

Although the possibility of graduating at will the choke opening and the respective metering, provided by the invention, reduces to a minimum the utility of an accelerator pump, when this is required it may be easily installed in one of the body portions which are not occupied by the chokes.

Figure 6:
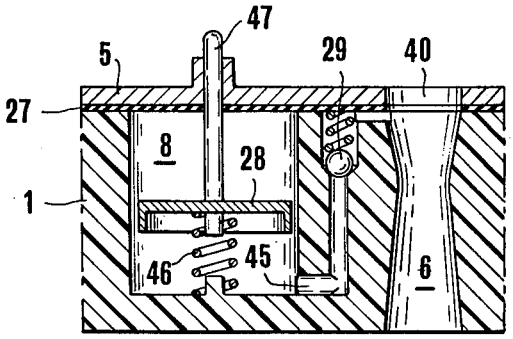
FIGS. 6 and 7 show some details in partial vertical cross sections taken along lines VI—VI and VII—VII of FIG. 3 respectively.

As shown in FIGS. 5 and 6, the accelerator pump has a plunger 28 inserted, without sealing, into a cylinder 8 formed in the body 1, adjacent to and communicating, above a wall 44, with the central fuel bowl 30 at constant level. A duct 45 extends from the cylinder 8 and opens through a nonreturn valve 29 into the first choke 6. The plunger 28 is pushed upwardly by a spring 46 and is connected to a stem 47 which acts as a tappet against a frontal cam 48 formed at the bottom side of lever 21 controlling the rotating shutter. Therefore, when the shutter is rotated in the direction to increase the choke opening, the stem 47 with the plunger 28 is lowered. Due to the lack of sealing of the plunger, if this action is slow no delivery is caused, but if the operation is swift, the fuel is pushed within the duct 45 and flows in the first choke 6 by providing the increased feeding required for a quick acceleration.

The device for cold starting, when it is required, may be simply formed by a flat element 24 pivoted on shaft 20 and sliding on cover 5 under the control of a non represented tie rod, which follows the chain line 50 or FIG. 1. The movement of the element 24 is limited, by stops 49 formed on the cover 5, between two positions, in one of which (normal operation) element 24 does not interfere with the chokes 6, while in the other (cold starting) the element 24 partially obstructs the first choke 6.

In the represented shape, the cover 5 is suitably arranged to receive on it the body of a usual air filter. But it is also possible to shape the cover 5 so that it forms a seat for the direct application of a filtering cartridge, thus avoiding the necessity for providing a special body for the filter, and simplifying the assembling operations.

The application of this invention allows the adoption of shapes particularly suitable for manufacture with a molded synthetic material, nevertheless, when this is required, the parts of the carburetor according to the invention may be produced from other materials, e.g. zamak (zinc-aluminium alloy) or by diecasting light alloy.

Even if a fuel bowl with the constant level maintained by an overflow seems particularly suitable for constructive reasons, it is clear that the carburetor may be provided with any other kind of constant level bowls, e.g. with a float.

The number of the chokes, exemplified as seven, may of course vary from a minimum of three up to a maximum determined by the admitted size of the carburetor. Their arrangement and, particularly, the angular distance between subsequent chokes may be variously chosen, and said angular distance may be uniform or different for the various chokes.

Other modifications may be made to the various parts, one embodiment of which has been described as a non limiting example, without departing from the scope of the invention.

I claim:

1. A carburetor for spark-ignition internal combustion engines, comprising a carburetor body, a distributor mounted on one face of said body, at least three chokes traversing said carburetor body towards said distributor, said distributor having holes therethrough corresponding to and in register with each of said chokes, a constant level fuel chamber, for each choke a feeding pipe having two ends, the first end of each said feeding pipe having a nozzle and the second end of each said feeding pipe ending in a nozzle throat area of the corresponding choke, a shutter mounted between said carburetor body and said distributor, said shutter being displaceable in a direction substantially perpendicular to said chokes and being adapted to uncover said chokes in sequence according to a predetermined rule, whereby said shutter rests sealingly against said distributor under the action of the intake depression of a said engine an uncovers distributor holes corresponding to the uncovered chokes, said chokes being parallel to one another, said shutter and distributor being flat and lying in a plane perpendicular to said chokes, said carburetor body having a geometrical center, said chokes being arranged along circle arcs around said center, said shutter being a disc rotating around said center and having arcuate openings therethrough, said chokes being subdivided in two groups, each group of chokes being arranged along a circle arc opposite to the circle arc along which is arranged the other group of chokes, said rotating shutter having two opposite arcuate openings adapted to uncover the chokes alternately from the one group and from the other group of chokes, said carburetor body having two arcuate fuel chambers concentric with and communicating with said central fuel chamber and disposed between said central fuel chamber and said chokes, said first end of each feeding pipe of the chokes being immersed in one of said arcuate fuel chambers.

2. A carburetor as set forth in claim 1, wherein said carburetor body has a central portion free from said chokes, and said constant level fuel chamber is located in said central portion of the carburetor body.

3. A carburetor as set forth in claim 2, wherein said carburetor body further comprises inlet and outlet connections for fuel, and said fuel chamber is directly connected to said inlet connection, and has an overflow and is connected to said outlet connection through said overflow.

4. A carburetor as set forth in claim 1, wherein said carburetor body has eccentric portions free from said chokes, the carburetor further comprising at least one complementary device of the group comprising a device for operation at the minimum speed and an accelerator pump, and said complementary devices are located in said eccentic portions of the carburetor body.

5. a carburetor as set forth in claim 1, further comprising a manifold, cover and a control device for said shutter, said distributor and manifold being mounted under said carburetor body, said cover being mounted over said carburetor body, and said control device comprising a control shaft connected to said shutter and traversing said carburetor body and said cover, and a control lever mounted on said shaft above said cover, said control lever having a return spring and means for connection to manoeuvre means such as a bowden cable or the like.

6. A carburetor as set forth in claim 5, further comprising an accelerator pump located inside said carburetor body, said accelerator pump comprising a plunger, a plunger stem and a return spring, said control lever having a bottom portion forming a frontal cam cooperating with said plunger stem of the accelerator pump.

7. A carburetor as set forth in claim 1, wherein some of said chokes and the nozzles of the corresponding feeding pipes are sized differently from the remaining chokes and nozzles.

8. A carburetor as set forth in claim 1, wherein said arcuate openings are arranged, with respect to the chokes, in such a manner that an end of one opening slightly overlaps one choke when an end of the other opening slightly overlaps the subsequent choke.

9. A carburetor as set forth in claim 1, wherein at least one component of the group comprising the carburetor body and the distributor is made of plastics.

* * * * *